US007056847B2

(12) United States Patent
Walker et al.

(10) Patent No.: US 7,056,847 B2
(45) Date of Patent: Jun. 6, 2006

(54) BINDER FOR HIGH WET-STRENGTH SUBSTRATES

(75) Inventors: James L. Walker, Whitehouse Station, NJ (US); Pavneet Mumick, Belle Mead, NJ (US); John C. Parsons, Easton, PA (US); David R. Nass, Bridgewater, NJ (US); Christopher Barcomb, Somerset, NJ (US)

(73) Assignee: Celanese International Corporation, Dallas, TX (US)

( * ) Notice: Subject to any disclaimer, the term of this patent is extended or adjusted under 35 U.S.C. 154(b) by 158 days.

(21) Appl. No.: 10/327,331

(22) Filed: Dec. 20, 2002

(65) Prior Publication Data

US 2003/0176133 A1 Sep. 18, 2003

Related U.S. Application Data

(60) Provisional application No. 60/349,968, filed on Jan. 18, 2002.

(51) Int. Cl.
*B32B 27/30* (2006.01)

(52) U.S. Cl. ..... 442/155; 442/85; 442/104; 442/152; 442/164

(58) Field of Classification Search ..... 442/85, 442/152, 155, 164, 166, 180, 104
See application file for complete search history.

(56) References Cited

U.S. PATENT DOCUMENTS

| | | | | |
|---|---|---|---|---|
| 4,288,499 | A * | 9/1981 | Kielbania, Jr. | 428/518 |
| 4,332,850 | A | 6/1982 | Iacoviello | 428/288 |
| 4,449,978 | A | 5/1984 | Iacoviello | 604/372 |
| 4,732,797 | A * | 3/1988 | Johnson et al. | 428/74 |
| 4,774,283 | A * | 9/1988 | Goldstein | 524/816 |
| 5,109,063 | A | 4/1992 | Cheng et al. | 524/820 |
| 5,540,987 | A | 7/1996 | Mudge et al. | 428/288 |
| 5,969,052 | A * | 10/1999 | Mumick et al. | 525/329.9 |
| 6,174,568 | B1 | 1/2001 | Kohlhammer et al. | |

FOREIGN PATENT DOCUMENTS

| | | |
|---|---|---|
| EP | 0 121 864 | 10/1984 |
| EP | 0 281 083 | 9/1988 |
| EP | 0 596 318 | 5/1994 |
| EP | 1 201 685 | 2/2002 |

* cited by examiner

*Primary Examiner*—Terrel Morris
*Assistant Examiner*—Andrew T. Piziali
(74) *Attorney, Agent, or Firm*—Michael W. Ferrell

(57) ABSTRACT

The present invention is directed to a fibrous substrate made of chemically bonded fibers, where the fibers are bound with a polymeric binder in an amount which is sufficient to bind the fibers together to form a self-sustaining web, and where the binder is characterized as having a wet tensile strength of greater than 4500 grams per inch (g/in) when measured at a 20 percent add-on on Whatman #4 CHR chromatography paper which is drum dried for 90 seconds at 210 to 215° F. and cured for 2 minutes at 300 to 325° F. Preferably the level of free formaldehyde in the fibrous substrate is less than 15 ppm. The emulsion binders of the invention may be used to bind fibers together in a substrate; may be used to bind pigment, colors or other substances to a substrate; may be used as a backing material; or may be used to finish or surface-treat a substrate. Because of the high level of crosslinking, substrates bound, or treated with the emulsion polymer have excellent wet strength and good durability/weatherability and water/solvent resistance.

26 Claims, No Drawings

BINDER FOR HIGH WET-STRENGTH SUBSTRATES

This application is based on provisional U.S. patent application No. 60/349,968 of the same title, filed on Jan. 18, 2002, the priority of which is hereby claimed.

FIELD OF THE INVENTION

The present invention relates to a self-cross-linking binder that provides fibrous substrates with a high wet-strength. Fibrous substrates that benefit from the use of the binder include non-woven, woven and paper products, fiberglass, and other similar materials.

BACKGROUND OF THE INVENTION

Non-woven materials and other fibrous products consist of a loosely assembled mass of fibers that are bound together with a polymeric binder to form a self-sustaining web that can be used to produce many items such as consumer towels, disposable wipes, absorbent media for feminine hygiene applications and diapers medical drapes, table-cloths, and high-grade napkins. The strength of the non-woven fabric, especially wet tensile strength, is an important property in many applications.

One way to improve the tensile strength of a non-woven material is through the incorporation of crosslinking monomers into the polymer. The crosslinking monomers are capable of self-crosslinking after application to the non-woven web. The most widely used crosslinking monomer in such applications is N-methylol acrylamide. There are two problems with the cross-linking monomers. First, is that there is an upper limit to amount of the cross-linking monomer that can be incorporated to produce a useful binder under current processes. Second, N-methylol acrylamide is a recognized source of formaldehyde, which is undesirable in most applications. Several methods have been used to take advantage of the higher tensile strength available from the use of N-methylol acrylamide, while keeping the residual formaldehyde levels low.

U.S. Pat. No. 4,449,978 discloses the use of acrylamide to replace some of the N-methylol acrylamide(NMA). With N-methylol levels of from 1.75 to 3.5 percent of the polymer, free formaldehyde levels of below 10 ppm were obtained.

U.S. Pat. No. 5,540,987 discloses the use of an ascorbic acid initiator system to reduce the free formaldehyde levels to less than 10 ppm for a non-woven binder containing from 0.5 to 10 percent, and preferably from 1–5 percent of N-methylol acrylamide or other crosslinking monomers. Exemplified are emulsion polymers having from 3 to 5 percent of NMA, formed at a polymerization temperature of 75 to 80° C.

There is a need for a binder that can provide a non-woven fabric with a higher level of wet tensile strength than currently available. For many applications, the high wet strength must be obtainable at a low level of formaldehyde.

Surprisingly it has been found that ethylene-vinyl acetate emulsion binders having higher levels of cross-linking monomer such as n-methylol acrylamide, that are made by a low temperature polymerization, produce non-woven products having high wet tensile strength, yet have low (less than 15 ppm) of formaldehyde.

SUMMARY OF THE INVENTION

The present invention is directed to a fibrous substrate made of chemically bonded fibers, where the fibers are bound with a polymeric binder in an amount which is sufficient to bind the fibers together to form a self-sustaining web. The binder is characterized as having an average cross-machine direction (CMD) wet tensile strength of greater than 4500 grams per inch (g/in) when measured at a 20 percent add-on on Whatman #4 Chromatography Paper which is drum dried for 90 seconds at 210 to 215° F. and cured for 2 minutes at 300 to 325° F.

The invention is also directed to a bonded substrate comprising a) a substrate comprising fibers; and
b) a polymeric binder comprising at least 6 percent, and preferably at least 7 percent, by weight of cross-linking monomer units, wherein said bonded substrate is characterized as having less than 15 ppm of free formaldehyde, and wherein said binder is present in an amount which is sufficient to bind the fibers together to form a self-sustaining web.

The invention is further directed to a non-woven product comprising a non-woven web of fibers bonded together with an emulsion polymer binder comprising a) at least 50 percent by weight percent of vinyl acetate units;
b) 0 to 40 percent by weight of ethylene units;
c) 6 to 20 percent by weight of crosslinking monomer units;
d) 0.1 to 7 percent by weight of acrylamide, methacrylamide, or a mixture thereof; and
e) 0 to 40 percent by weight of other co-monomers wherein said non-woven product has a free formaldehyde content after drying of less than 15 ppm.

The invention is directed further to a treated fibrous substrate comprising natural or synthetic fibers that may be woven or non-woven, and having coated thereon an emulsion polymer, wherein the level of free formaldehyde in the fibrous substrate is less than 15 ppm, and where the emulsion polymer is characterized as having a wet tensile strength of greater than 4500 grams per inch (g/in) when measured at a 20 percent add-on on Whatman #4 chromatography paper which is drum dried for 90 seconds at 210 to 215° F. and cured for 2 minutes at 300 to 325° F.

DETAILED DESCRIPTION OF THE INVENTION

The invention is directed to fibrous substrates that are bound together by a polymeric binder. The polymeric binder contains cross-linking monomer units that provide the product with high strength. Preferably the bonded fibrous substrate has web formaldehyde in the finished product is less than 15 ppm.

By "web formaldehyde", "free formaldehyde", or "fabric formaldehyde" as used herein is meant the amount of water-extractable formaldehyde as measured by the Japanese Ministry of Health method JM 112-1973. A low web formaldehyde level as used herein means a level of extractable formaldehyde in the final product of below 15 ppm, and preferably below 10 ppm.

The polymeric binder of the present invention preferably is a crosslinkable emulsion polymer. By "crosslinkable" as used herein is meant a polymer that is capable of undergoing crosslinking, either by a self-crosslinking mechanism, or by the incorporation of at least one functional monomer into the polymer backbone which can undergo a post-polymerization crosslinking reaction to form crosslinks. Improved wet strength may also be achieved via the addition of external crosslinkers such as melamine-formaldehyde, urea-formaldehyde, phenol-formaldehyde, gloyoxal adducts, and other similar chemistries well known in the art. These crosslinkers are not polymerized onto the polymer backbone, but are rather post-added to the polymer mix. The negatives associated with these additives are often binder stability, and increased levels of free formaldehyde. For the purposes of this invention, a polymeric binder is defined as one that has all crosslinking moieties polymerized directly onto the polymer backbone, and excludes any system that requires the subsequent, or post-addition of an external crosslinking agent. Acid catalysts may be post-added to enhance the crosslinking reaction, but it is well known that these catalysts do not take part in the crosslinking reaction itself.

In a preferred embodiment, the polymeric binder is formed from vinyl acetate; at least one crosslinkable monomer; either acrylamide or methacrylamide; and optionally other ethylenically unsaturated monomers.

The primary monomer is vinyl acetate and the emulsions of this invention are derived from polymers containing at least 50 percent by weight of vinyl acetate.

The crosslinking monomers used herein include N-methylol acrylamide, N-methylol methacrylamide, N-methylol allyl carbamate, iso-butoxy methyl acrylamide and n-butoxy methyl acrylamide, or a mixture thereof. The preferred crosslinking monomers are N-methylol acrylamide as well as a blend of N-methylol acrylamide and acrylamide. An example of a blend is NMA-LF which is commercially available from Cytec Industries. Acrylamide, methacrylamide, or a mixture thereof is also used in forming the polymeric binder. These monomers have some limited cross-linking capability. The (meth)acrylamide may be included as part of a mixture with the crosslinking monomer, as mentioned above. Acrylamide, or methacrylamide are present at from 0.1 to 7 percent by weight, based on the weight of the polymer, and preferably from 1 to 5 percent by weight. The crosslinking monomer is generally used at levels above 6 percent, preferably from 7 to 20 percent, and more preferably from 7 to 12 percent based upon the weight of the polymer.

In addition to vinyl acetate and a crosslinking monomer, the preferred polymeric binder may be copolymerized with at least one of any conventionally employed comonomers. Suitable comonomers include those selected from the class of ethylene; vinyl chloride; vinyl esters of aliphatic carboxylic acids containing 1–20 carbon atoms; dialkyl esters of maleic and fumaric acid containing 1–8 carbon atoms in each alkyl group; and $C_1$–$C_8$ alkyl acrylates and methacrylates. These comonomers may be present in the emulsion copolymers at levels up to 48 percent by weight of the total polymer composition. In the case where ethylene is the comonomer, it is generally used in amounts up to about 40 percent by weight. A preferred copolymer of the present invention is one formed from vinyl acetate and ethylene.

Olefinically-unsaturated carboxylic acids may be used in an emulsion polymer. These include the alkanoic acids having from 3 to 6 carbon atoms or the alkenedioic acids having from 4 to 6 carbon atoms, like acrylic acid, methacrylic acid, crotonic acid, itaconic acid, maleic acid or fumaric acid, or mixtures thereof in amounts sufficient to provide up to about 4 percent by weight, of monomer units in the copolymer.

Optionally, polyunsaturated copolymerizable monomers may also be present in small amounts, i.e., up to about 1 percent by weight. Such comonomers would include those polyolefinically-unsaturated monomers copolymerizable with vinyl acetate, for example, vinyl crotonate, allyl acrylate, allyl methacrylate, diallyl maleate, divinyl adipate, diallyl adipate, diallyl phthalate, ethylene glycol diacrylate, ethylene glycol dimethacrylate, butanediol dimethacrylate, methylene bis-acrylamide, triallyl cyanurate, etc. In addition, certain copolymerizable monomers which assist in the stability of the copolymer emulsion, e.g., sodium vinyl sulfonate, are also useful herein as latex stabilizer. These optionally present monomers, if employed, are added in very low amounts of from 0.1 to about 2 percent by weight of the monomer mixture.

The "characteristic wet strength value" provided by a binder is measured by applying a 20 percent by weight add-on of the binder on Whatman #4 CHR Chromatography Paper via a saturation process. The paper is then drum dried for 90 seconds at 210 to 215° F. and cured for 2 minutes at 300 to 325° F. 1 inch×5 inch strips of the saturated Whatman paper are cut with the 5 inch length in the cross-machine direction (CMD). Tensile strength is measured on a standard Instron tensile tester, set at 3 inch gauge length and 1 inch per min. crosshead speed. Wet tensile strength is measured after soaking specimens for one minute in a 1.0 percent solution of Aerosol OT wetting agent. 5–7 tensile strips are measured for wet tensile strength and an average value is taken. The characteristic wet strength value provided by a binder is reported in grams per inch.

The emulsions are prepared using conventional batch, semi-batch or semi-continuous emulsion polymerization procedures. Batch polymerization is preferred as it generally produces higher molecular weight polymers, and higher molecular weight polymers lead to higher wet strength binders. Generally, the monomers are polymerized in an aqueous medium in the presence of the redox initiator system and at least one emulsifying agent.

If a batch process is used, the vinyl acetate and any optional non-functional monomers such as ethylene are suspended in water and are thoroughly agitated while being gradually heated to polymerization temperature. The homogenization period is followed by a polymerization period during which the initiator and functional monomers including N-methylol acrylamide are added incrementally or continuously. The functional monomers are added slowly to the reaction to minimize homopolymerization of the functional monomers, and instead promote incorporation of the functional monomers into the polymer backbone. If the slow addition procedure is employed, the vinyl acetate and any optional comonomers are added gradually throughout the polymerization reaction. In either case, the polymerization is performed at temperatures from 25° C. to 60° C., preferably from 35° C. to 60° C., for sufficient time to achieve a low residual monomer content, e.g., from 0.5 to about 10 hours, preferably from 2 to 6 hours, to produce a latex having less than 1 percent, preferably less than 0.2 weight percent, free monomer. The lower reaction temperature range for the polymerization allows for a more controlled conversion rate, allowing for the incorporation of a higher level of crosslinking monomer.

In the case of vinyl ester copolymers containing ethylene, processes suitable for the emulsion polymerization are described in U.S. Pat. No. 5,540,987, incorporated herein by reference.

The initiator system is generally a redox system, which is effective for lower temperature polymerizations. Redox systems using persulfate or peroxide initiators along with a reducing agent are preferred. Peroxide initiators, and most preferably tert-butyl hydrogen peroxide (tBHP) may be used to initiate polymerization. One particularly preferred initiator system comprises a hydrophobic hydroperoxide, in amounts of between 0.05 and 3 percent by weight, preferably 0.1 and 1 percent by weight based on the total amount of the emulsion and ascorbic acid, in amounts of 0.05 to 3 percent by weight, preferably 0.1 to 1 percent by weight, based on the total amount of the emulsion. The redox initiator system is slow-added during the polymerization.

To control the generation of free radicals, a transition metal often is incorporated into the redox system, and such metals include an iron salt, e.g., ferrous and ferric chloride and ferrous ammonium sulfate. The use of transition metals and levels of addition to form a redox system for polymerization mediums are well-known.

The polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkali metal phosphates. Polymerization regulators, like mercaptans, chloroform, methylene chloride and trichloroethylene, can also be added in some cases.

Useful dispersing agents are emulsifiers, surfactants, and protective colloids generally used in emulsion polymerization, or a mixture thereof. The emulsifiers can be anionic, cationic or nonionic surface active compounds, as known in the art. The emulsifiers can be anionic, cationic or nonionic surface active compounds. Suitable anionic emulsifiers are, for example, alkyl sulfonates, alkylaryl sulfonates, alkyl sulfates, sulfates of hydroxylalkanols, alkyl and alkylaryl disulfonates, sulfonated fatty acids, sulfates and phosphates of polyethoxylated alkanols and alkyphenols, as well as esters of sulfosuccinic acid. Suitable cationic emulsifiers are, for example, alkyl quaternary ammonium salts, and alkyl quaternary phosphonium salts. Examples of suitable nonionic emulsifiers are the addition products of 5 to 50 moles of ethylene oxide adducted to straight-chained and branch-chained alkanols with 6 to 22 carbon atoms, or alkylphenols, of higher fatty acids, or higher fatty acid amides, or primary and secondary higher alkyl amines; as well as block copolymers of propylene oxide with ethylene oxide and mixtures thereof. When combinations of emulsifying agents are used, it is advantageous to use a relatively hydrophobic emulsifying agent in combination with a relatively hydrophilic agent. The amount of emulsifying agent is generally from about 1 to 10, preferably from about 2 to about 8, weight percent of the monomers used in the polymerization. Various protective colloids may also be used in addition to the emulsifiers described above. Suitable colloids include polyvinyl alcohol, partially acetylated polyvinyl alcohol, e.g., up to 50 percent acetylated, casein, hydroxyethyl starch, carboxymethyl cellulose, gum arabic, and the like, as known in the art of synthetic emulsion polymer technology. In general, these colloids are used at levels of 0.05 to 4 percent by weight, based on the total emulsion.

The dispersing agent used in the polymerization may be added in its entirety to the initial charge, or a portion of the emulsifier, e.g., from 25 to 90 percent thereof, can be added continuously or intermittently during polymerization.

The polymerization reaction is generally continued until the residual vinyl acetate monomer content is below about 1 percent, preferably less than 0.2 percent. The completed reaction product is then allowed to cool to about room temperature, while sealed from the atmosphere.

The emulsions are produced and used at relatively high solids contents, e.g., between 35 to 60 percent, preferably 50 to 55 percent, although they may be diluted with water as desired. Preferably the viscosity of the emulsion at 50 percent solids is less than 500 cps.

The particle size of the latex can be regulated by the quantity of nonionic or anionic emulsifying agent or protective colloid employed. To obtain smaller particles sizes, greater amounts of emulsifying agents are used. As a general rule, the greater amount of the emulsifying agent employed, the smaller the average particle size.

Polymeric binders of the present invention generally have a Tg in the range of from −60° C. to +50° C., and preferably between −40° and +35° C.

One significant property of fibrous substrates treated with the polymeric binder of the invention is excellent wet strength. Wet strength of a binder can be determined by measurement on Whatman #4 CHR Chromatography Paper, and this measurement is applicable for determining wet strength in a variety of applications, and on a variety of substrates. Wet strength is measured by applying a 20 percent by weight add-on of the binder on Whatman #4 CHR Chromatography Paper via a saturation process. The paper is then drum dried for 90 seconds at 210 to 215° F. and cured for 2 minutes at 300 to 325° F. 1 inch×5 inch strips of the saturated Whatman paper are cut with the 5 inch length in the cross-machine direction (CMD). Tensile strength is measured on a standard Instron tensile tester, set at 3 inch gauge length and 1 inch per min. crosshead speed. Wet tensile strength is measured after soaking specimens for one minute in a 1.0 percent solution of Aerosol OT wetting agent. 5–7 tensile strips are measured for wet tensile strength and an average value is taken. When tested by this method, the polymeric binders of the present invention have an average cross-machine direction wet strength of greater than 4500 grams per inch, preferably greater than 4750 grams per inch, and most preferably greater than 5000 grams per inch. The high wet strength found in substrates of the present invention allows a manufacturer to achieve a much higher wet-strength non-woven product using an equivalent amount of add-on, or alternatively may achieve an equivalent wet strength with a lower add-on—and thus a material cost saving.

The emulsion binders of the invention may be used to bind fibers together in a substrate; may be used to bind pigment, colors or other substances to a substrate; may be used as a backing material; or may be used to finish or surface-treat a substrate.

The emulsion binders can be used to produce a non-woven product. A non-woven product of the present invention is a chemically-bonded dry-formed web, as opposed to a mechanically tangled or thermally bonded web. The web may be formed by any process known in the art, such as a carded, air-laid, dry-laid, wet-laid, or air-formed process. The fibers can be natural, synthetic, or a mixture thereof. The binder is applied to the fiber by any means known in the art, such as print, foam, saturate, coating, and spraying; then dried on steam cans or ovens as currently practiced in the production of non-woven rolled goods. Binder add-on levels for non-wovens useful in the present invention can be from 0.1 to 100 percent, preferably from 3 to 30 percent. Non-wovens made with the binder of the present invention are useful in applications in which wet integrity or resiliency is important, such as wipes, diapers, feminine hygiene, medical, and filtration products. Non-woven wipes may be used in the dry form and wetted just prior to use, or may be pre-moistened with either aqueous or organic solvents as known in the art. Wipes are useful in applications that include household cleaning, personal cleansing, baby wipes, and industrial wipes. Non-wovens of the invention includes both disposable non-woven products, as well as durable non-wovens such as abrasive pads, medical fabrics, and apparel lining.

The emulsion binder of the invention may also be used as a binder for double re-creped paper. Double recreped paper is used in products such as toweling. The binder is print applied at an add-on level of about 4 to 20 percent.

The emulsion binder may be used to bind other fibers, such as fiberglass, and carbon fibers, by means known in the art.

The emulsion polymer binders of the invention are additionally useful in binding pigments, colors or other substances to a substrate. Applications would include paper finishes, colored paper binders, and abrasive pads including sanding papers.

The polymer can be used as a coating or treatment on woven and non-woven fabrics, to improve the strength and durability of the substrate, especially in contact with aqueous or non-aqueous liquids.

Paper and vinyl products coated with the emulsion can be used in applications in which wet strength is an important property, such as in wall coverings that require a high wet tear strength.

The properties of the polymer make it useful in backing for carpet, and flooring applications such as vinyl flooring.

The high level of crosslinking in the emulsion polymer provides substrates treated with the polymer, either as a binder of a coating, with good durability, weatherability and resistance to water and solvents. In addition to woven and non-woven fabrics, other materials benefiting from treatment with the emulsion include, but are not limited to, metal, leather, wood, canvas, awnings, tarpolins, flocking upholstery, and fiberfill.

The following examples are presented to further illustrate and explain the present invention and should not be taken as limiting in any regard.

EXAMPLE 1

A general procedure for the preparation of a vinyl acetate-ethylene copolymer emulsion of the invention is as follows:

The initial charge to the reactor includes the following:

| | | |
|---|---|---|
| | Water (deionized) | 2200.0 g |
| | Ferrous sulfate (1% aq. sol'n) | 16.0 |
| | Sod. Vinyl sulfonate (25%) | 96.0 |
| | Sod. Lauryl ether sulfate (3EO), 30% Aq. | 100.0 |
| | Fatty Alcohol (C12/14) Ethoxylate (10EO), 80% | 40.0 |
| | Fatty Alcohol (C12/14) Ethoxylate (30EO), 65% | 45.0 |
| | Sodium acetate | 0.5 |
| | Ethylenediaminetetraacetic acid (1%) | 16.0 |
| | Phosphoric acid | 1.5 |
| | Ascorbic acid | 1.6 |
| | Vinyl acetate | 3000.0 g |
| | Ethylene—amount to equilibrate reactor to 750 psi at 50° C. | |
| Slow additions: | | |
| 1. | Water | 800.0 |
| | Sodium Lauryl ether sulfate (3EO), 30% Aq. | 40.0 |
| | Fatty Alcohol (C12/14) Ethoxylate (10EO), 80% | 40.0 |
| | Fatty Alcohol (C12/14) Ethoxylate (30EO), 65% | 45.0 |
| | Sodium acetate | 1.8 |
| | NMA-LF (48%)* | 580.0 |
| | Sodium Dioctyl sulfosuccinate (75%) | 30.0 |
| 2. | Water (deionized) | 250.0 g |
| | t-butyl hydroperoxide (70% aq. sol'n) | 16.0 |
| 3. | Water (deionized) | 250.0 g |
| | Ascorbic acid | 12.0 |

*NMA-LF is a blend of n-methylol acrylamide/acrylamide (48% aq. Solution) commercially available from Cytec Industries.

The pH of the initial aqueous charge was adjusted to 4.0–4.3 with the phosphoric acid.

A 10L stainless steel pressure reactor was filled with initial aqueous mix. It was flushed with nitrogen. With the agitation at about 250 rpm, the vinyl acetate was added. After closing all reactor ports, it was purged twice with nitrogen (25 to 40 psi) and then with ethylene (50 psi). It was then heated to 50° C. Agitation was increased to 550 rpm and it was pressurized with ethylene to 750 psi. The reactor temperature and ethylene pressure were allowed to equilibrate for 15–20 minutes. The ethylene supply was then closed off. Agitation was reduced to 400 rpm.

The reaction was initiated by starting both redox slow-additions (no. 2 and 3) at 2.5 hr. rates (80 cc/hr). After the initial temperature rise, about 2–5° C., the jacket temperature and oxidizer rate (no. 2) are adjusted to allow the temperature to reach 60° C. in about 15 minutes. The slow addition, no. 1, was started and added over 4 hrs. During the run, the oxidizer and reducer rates are adjusted to maintain conversion rate with the reaction run at 60° C. The reaction is continued until the residual vinyl acetate is reduced to 1.5–2.0% (about 2–2.5 hrs). It is then cooled to 45° C. and transferred to the degassing tank to vent off residual ethylene pressure. Defoamer, Colloid 681f (Allied Colloids), was added to the degassing tank followed by finishing redox initiator. This includes 15 g of a 6% t-BHP solution, waiting 5 minutes, then 15 g of a 6% Ascorbic acid solution added over 15 minutes. This reduces the vinyl acetate to <0.3%. After cooling to 30° C., the pH is adjusted to 4–5 with 14% ammonium hydroxide.

| The emulsion had the final properties: | |
|---|---|
| Solids, % | 48.5 |
| Viscosity (20 rpm, RVT#3) | 640 cps |
| pH | 4.0 |
| %grit (200 mesh) | 0.020 |
| Tg, ° C. | −15° |

EXAMPLE 2

The process of Ex. 1 is repeated, but the VA/E ratio is changed. The vinyl acetate added initially is 3200 g., and the ethylene pressure charged initially is 600 psi. The reaction was run as in Ex. 1 at 60° C. and with a 4 hr slow-add of 1. (crosslinking monomer)

| The emulsion had the final properties: | |
|---|---|
| Solids, % | 50.5 |
| Viscosity (20 rpm, RVT#3) | 1300 cps |
| pH | 4.0 |
| %grit (200 mesh) | 0.020 |
| Tg, ° C. | 0° |

EXAMPLE 3

The emulsion made as in Ex. 2, with the level of crosslinking monomer, NMA-LF, increased to 692 g. The reaction was run the same as in Ex. 1. The final emulsion had the following properties:

| | |
|---|---|
| Solids, % | 49.6 |
| Viscosity (20 rpm, RVT#3) | 750 cps |
| pH | 4.0 |
| %grit (200 mesh) | 0.030 |
| Tg, ° C. | 0° |

EXAMPLE 4

The emulsion made as in Ex. 1, with the crosslinking monomer changed to NMA II* at 600 g. The reaction was run the same as in Ex. 1. The final emulsion had the following properties:

| | |
|---|---|
| Solids, % | 50.5 |
| Viscosity (20 rpm, RVT#3) | 480 cps |
| pH | 4.0 |
| %grit (200 mesh) | 0.030 |
| Tg, ° C. | −17° |

*NMA II is a 48% aq. solution of NMA with reduced formaldehyde made according to U.S. Pat. No. 5,415,926.

EXAMPLE 5

Ex. 1 with increased Type II NMA adding at 720 g. The final emulsion had the following properties:

| | |
|---|---|
| Solids, % | 49.6 |
| Viscosity (20 rpm, RVT#3) | 372 cps |
| pH | 3.7 |
| %grit (200 mesh) | 0.020 |
| Tg, ° C. | −15° |

EXAMPLE 6

Ex. 2 with NMA LF replaced with 720 g of NMA-II. The final emulsion had the following properties:

| | |
|---|---|
| Solids, % | 50.5 |
| Viscosity (20 rpm, RVT#3) | 1350 cps |
| pH | 4.0 |
| %grit (200 mesh) | 0.020 |
| Tg, ° C. | 0° |

EXAMPLE 7

Ex. 2 with the NMA LF replaced with 775 g NMA II. The final emulsion had the following properties:

| | |
|---|---|
| Solids, % | 50.7 |
| Viscosity (20 rpm, RVT#3) | 450 cps |
| pH | 4.0 |
| %grit (200 mesh) | 0.030 |
| Tg, ° C. | 0° |

EXAMPLE 8

The recipe as in Ex 2. With the level of crosslinking monomer, NMA-LF at 666 g in slow addition 1. However the polymerization was run at 85° C.

| | |
|---|---|
| Solids, % | 49.6 |
| Viscosity (20 rpm, RVT#3) | 220 cps |
| pH | 3.9 |
| %grit (200 mesh) | 0.015 |
| Tg, ° C. | 0° |

EXAMPLE 9

The composition of Ex. 8, however the polymerization was run at 75° C. The final emulsion had the following properties:

| | |
|---|---|
| Solids, % | 49.6 |
| Viscosity (20 rpm, RVT#3) | 1250 cps |
| pH | 3.9 |
| %grit (200 mesh) | 0.020 |
| Tg, ° C. | 0° |

EXAMPLE 10

The composition of Ex. 2 however 600 g of the initial vinyl acetate was replaced with Veova 10 monomer. The process was run as in the example at 60° C. The final emulsion had the following properties:

| | |
|---|---|
| Solids, % | 50.9 |
| Viscosity (20 rpm, RVT#3) | 580 cps |
| PH | 3.7 |
| %grit | 0.020 |
| Tg, ° C. | −17° C. |

EXAMPLE 11

The recipe was made as in Ex 2. with the level of crosslinking monomer, NMA-LF at 650 g in slow addition 1, and the sodium acetate reduced to 1 g. The reducing agent, ascorbic acid, was replaced throughout with Bruggolite FF6; a commercially available sulfinic acid type from L. Bruggemann Co. The polymerization was run at 60° C.

| | |
|---|---|
| Solids, % | 49.8 |
| Viscosity (20 rpm, RVT#3) | 340 cps |
| pH | 4.8 |
| %grit (200 mesh) | 0.020 |
| Tg, ° C. | 0° |

EXAMPLE 12 COMPARATIVE EXAMPLE

DUR-O-SET Elite 22, a −15° C. $T_g$ self-crosslinking EVA emulsion copolymer commercially available from National Starch and Chemical Company.

EXAMPLE 13 COMPARATIVE EXAMPLE

AIRFLEX 192, a +12° C. $T_g$ self-crosslinking EVA emulsion copolymer commercially available from Air Products and Chemicals, Inc.

TABLE 1

| Example # | Reaction Temperature ° C. | Tg ° C. | Crosslinking Monomer Type | Crosslinking Monomer Level pts. phm | CMD Wet Tensile g/in | Fabric Formaldehyde ppm |
|---|---|---|---|---|---|---|
| 1 | 60 | −15 | NMA LF | 7 | 4765 | |
| 2 | 60 | 0 | NMA LF | 7 | 4720 | |
| 3 | 60 | 0 | NMA LF | 8.3 | 5065 | 11 |
| 4 | 60 | −15 | NMA II | 7 | 4610 | |
| 5 | 60 | −15 | NMA II | 8.3 | 4825 | |
| 6 | 60 | 0 | NMA II | 8.3 | 5135 | 20 |
| 7 | 60 | 0 | NMA II | 9 | 4891 | |
| 8 | 85 | 0 | NMA LF | 8 | 4421 | 11 |
| 9 | 75 | 0 | NMA LF | 8 | 4652 | 9 |
| 10 | 60 | −20 | NMA LF | 7 | 4559 | |
| 11 | 60 | 0 | NMA LF | 8 | 4160 | 17 |
| 12 | | −15 | | | 3710 | 14 |
| 13 | | +10 | | | 4306 | |

CMD Wet Tensile Performance is generated utilizing the aforementioned procedure of applying the emulsion polymer to Whatman #4 CHR chromatography paper to a 20 percent by weight add-on. The add-on is achieved by utilizing a bath solids of 20 to 30 percent solids. All examples include 0.75 percent to 1.0 percent acid catalyst (polymer solids on catalyst solids). The paper is then drum dried for 90 seconds at 210 to 215° F. and cured for 2 minutes at 300 to 325° F. 1 inch×5 inch strips of the saturated Whatman paper are cut with the 5 inch length in the cross-machine direction (CMD). Tensile strength is measured on a standard Instron tensile tester, set at 3 inch gauge length and 1 inch per minute crosshead speed. Wet tensile strength is measured after soaking specimens for one minute in a 1.0 percent solution of Aerosol OT wetting agent. 5–7 strips are pulled on the Instron in the cross-machine direction to generate the wet tensile strength values and an average measurement is taken.

Examples 14–25 were completed by producing airlaid nonwoven structures on an M&J Fibretech pilot airlaid machine in Horsens, Denmark. DUR-O-SET Elite 33, a $^{+}$10 Tg self-crosslinking EVA copolymer commercially available from National Starch and Chemical Company and AIRFLEX 192, a $^{+}$10 Tg self-crosslinking EVA copolymer commercially available from Air Products and Chemicals, Inc. Airlaid nonwoven structures were produced utilizing machine line speeds of 50 meters per minute with an exit sheet temperature of 155° C. The airlaid basesheet conditions consist of a target basis weight of 55 grams per square meter (gsm) and a caliper range of 0.8–1.1 millimeters (mm). Polymer add-on targeted 14 percent and 18 percent by weight of the final nonwoven and was achieved via spray-application of the binder at dilution solids of 12 to 13 percent. All airlaid structures utilized Weyerhaeuser NB416 fluff pulp which is commercially available from Weyerhaeuser Company.

TABLE 2

| Example # | Polymer Type | Polymer Add-On % | Basis Weight gsm | Caliper mm | CMD Wet Tensile N/5 cm |
|---|---|---|---|---|---|
| 14 | Example 3 | 14 | 53.6 | 1.00 | 4.3 |
| 15 | Example 3 | 14 | 54.6 | 0.70 | 7.3 |
| 16 | Example 3 | 18 | 54.2 | 1.00 | 5.9 |
| 17 | Example 3 | 18 | 54.5 | 0.75 | 10.4 |
| 18 | Elite 33 | 14 | 54.1 | 1.00 | 3.9 |
| 19 | Elite 33 | 14 | 54.5 | 0.75 | 5.5 |
| 20 | Elite 33 | 18 | 53.2 | 0.95 | 4.7 |
| 21 | Elite 33 | 18 | 54.8 | 0.75 | 7.5 |
| 22 | Airflex 192 | 14 | 53.7 | 1.05 | 2.9 |
| 23 | Airflex 192 | 14 | 54.7 | 0.75 | 6.2 |
| 24 | Airflex 192 | 18 | 53.7 | 1.00 | 5.1 |
| 25 | Airflex 192 | 18 | 55.9 | 0.80 | 8.5 |

CMD wet tensile performance was completed utilizing EDANA test method EDANA 20.2-89 in water. All polymers were formulated with 0.75 percent to 1.0 percent acid catalyst (polymer solids on catalyst solids) and AIRFLEX 192 included an additional formulation of 1 percent dioctyl sulfosuccinate surfactant (polymer solids on surfactant solids). CMD wet measurement is defined in Newton per 5 centimeters (N/5 cm)

What is claimed is:

1. A fibrous substrate comprising fibers bonded with an emulsion polymer binder, said polymer comprising:

a) at least 50 percent by weight percent of vinyl acetate monomer units;

b) 0 to 40 percent by weight of ethylene monomer units;

c) 5 to 20 percent by weight of cross-linking monomer composition; and d) 0 to 40 percent by weight of other co-monomers, wherein said polymer binder provides a characteristic wet strength value of greater than 4,500 g/in.

2. The fibrous substrate of claim 1 wherein said substrate is a non-woven material.

3. The fibrous substrate of claim 2 wherein said non-woven material comprises a chemically-bonded dry-formed non-woven web.

4. The fibrous substrate of claim 1 wherein said fibers are natural fibers, synthetic fibers, or a mixture thereof.

5. The fibrous substrate of claim 1 wherein said cross-linking monomer comprises a blend of n-methylol acrylamide and acrylamide.

6. The fibrous substrate of claim 2 wherein said non-woven material is formed by an air-laid process.

7. The fibrous substrate of claim 1 wherein said substrate is a double recreped paper, fiberglass, an abrasive pad, a carpet or a floor covering, a wall covering, a fiberfill, or a paper.

8. The fibrous substrate of claim 1 comprising at least 7 percent by weight of cross-linking monomer composition.

9. The non-woven product of claim 1, comprising 7 to 12 percent by weight of cross-linking monomer composition.

10. The fibrous substrate of claim 1, wherein the cross-linking monomer composition comprises compounds with N-methylol(meth)acrylamide and/or N-alkoxy methyl (meth)acrylamide.

11. The fibrous substrate of claim 1, wherein the cross-linking monomer composition is selected from the group consisting of: N-methylol acrylamide; N-methylol methacrylamide; a blend of N-methylol acrylamide and acrylamide; N-methylol allyl carbamate, iso-butoxy methyl acrylamide, n-butoxy methyl acrylamide, and mixtures thereof.

12. The fibrous substrate of claim 1, wherein the cross-linking monomer composition comprises N-methylol acrylamide.

13. The fibrous substrate of claim 1, wherein the cross-linking monomer composition consists essentially of a blend of N-methylol acrylamide and acrylamide.

14. The fibrous substrate of claim 1, wherein the polymer comprises from 6 to 20 wt. percent cross-linking monomer composition.

15. The fibrous substrate of claim 1, wherein the polymer comprises about 7 wt. percent cross-linking monomer composition.

16. The fibrous substrate of claim 1, wherein the polymer comprises about 8 wt. percent cross-linking monomer composition.

17. The fibrous substrate of claim 1, wherein said polymer binder provides a characteristic wet strength value of greater than 4750 grams per inch (g/in).

18. The fibrous substrate of claim 1, wherein said polymer binder provides a characteristic wet strength value of greater than 5000 grams per inch (g/in).

19. The fibrous substrate of claim 1, wherein said fibrous substrate is characterized as having a free formaldehyde level of less than 15 ppm.

20. The fibrous substrate of claim 1, wherein the emulsion polymer is an ethylene-vinyl acetate copolymer.

21. A fibrous nonwoven web which includes a polymer binder that is derived from an aqueous emulsion, wherein said binder comprises an ethylene-vinyl acetate copolymer with from 6 to 20 wt. percent of cross-linking monomer composition, wherein the aqueous emulsion exhibits a viscosity of less than 1350 cps when measured at a solids content of about 50 wt. percent, and wherein said polymer binder provides a characteristic wet strength value of greater than 4,500 g/in.

22. The fibrous substrate of claim 21, wherein the aqueous emulsion exhibits a viscosity of less than 750 cps when measured at a solids content of about 50 weight percent.

23. The fibrous substrate of claim 21, wherein the aqueous emulsion exhibits a viscosity of less than 500 cps when measured at a solids content of about 50 weight percent.

24. The fibrous substrate of claim 21, wherein the aqueous emulsion exhibits a viscosity of less than 350 cps when measured at a solids content of about 50 weight percent.

25. The fibrous substrate of claim 21, wherein the polymer binder is emulsion polymerized at a reaction temperature in the range of from 25° C. to 60° C. for a controlled conversion rate with a redox initiator system that is slow-added during polymerization such that the rate of addition is adjusted to maintain conversion rate.

26. The fibrous substrate of claim 21, wherein the polymer binder is emulsion polymerized in the presence of a transition metal or salt thereof, and a chelating agent.

* * * * *